US010470575B2

(12) United States Patent
Piretti

(10) Patent No.: US 10,470,575 B2
(45) Date of Patent: Nov. 12, 2019

(54) FOLDING CHAIR

(71) Applicant: Pro-Cord S.p.A., Bologna (IT)

(72) Inventor: Giancarlo Piretti, Bologna (IT)

(73) Assignee: PROCORD S.P.A., Bologna (IT)

( * ) Notice: Subject to any disclaimer, the term of this patent is extended or adjusted under 35 U.S.C. 154(b) by 0 days.

(21) Appl. No.: 16/039,871

(22) Filed: Jul. 19, 2018

(65) Prior Publication Data

US 2019/0021502 A1 Jan. 24, 2019

(30) Foreign Application Priority Data

Jul. 20, 2017 (IT) ..... 102017000082714

(51) Int. Cl.
*A47C 4/10* (2006.01)
*A47C 4/20* (2006.01)

(52) U.S. Cl.
CPC . *A47C 4/10* (2013.01); *A47C 4/20* (2013.01)

(58) Field of Classification Search
CPC .... A47C 4/10; A47C 4/20; A47C 4/12; A47C 4/00; A47C 4/04; A47C 4/14; A47C 4/24; A47C 4/28; A47C 4/38; A47C 4/48; A47C 5/10
USPC ..... 297/60, 59, 55, 56, 58
See application file for complete search history.

(56) References Cited

U.S. PATENT DOCUMENTS 1,815,643 A * 7/1931 Allerding ..... A47C 4/14 297/55
1,838,213 A * 12/1931 Buffington ..... A47C 4/14 297/55
3,705,744 A 12/1972 Piretti et al.
3,815,952 A * 6/1974 Minsker ..... A47C 4/24 297/47
3,982,785 A * 9/1976 Ambasz ..... A47C 1/023 297/160
5,681,078 A * 10/1997 Chen ..... A47C 4/14 297/55
6,899,384 B1 * 5/2005 Tseng ..... A47C 4/24 297/16.1

(Continued)

FOREIGN PATENT DOCUMENTS

JP S4824709 U 3/1973

OTHER PUBLICATIONS

Italian Search Report and Written Opinion dated May 7, 2018 for Application No. 201700082714.

*Primary Examiner* — Mark R Wendell
(74) *Attorney, Agent, or Firm* — Patterson + Sheridan, LLP

(57) ABSTRACT

A folding chair comprising: a first structure including a pair of front legs and a backrest, a second structure including a pair of rear legs movable with respect to the first structure between an open position and a closed position, and a seat movable about an articulation axis between a lowered position and a raised position, wherein the seat comprises: a support frame pivoting about said articulation axis between a lowered position and a raised position, a seating element movable with respect to the support frame along a direction transverse with respect to said articulation axis, and at least one transmission mechanism configured to move the seating element along said direction between a first position corresponding to the lowered position of the support frame and a second position corresponding to the raised position of the support frame.

8 Claims, 7 Drawing Sheets

(56) References Cited

U.S. PATENT DOCUMENTS

| | | | | |
|---|---|---|---|---|
| 7,080,877 | B1 * | 7/2006 | Tsai | A47C 4/14<br>297/16.1 |
| 2003/0234562 | A1 * | 12/2003 | Huang | A47C 4/18<br>297/57 |

* cited by examiner

FOLDING CHAIR

CROSS-REFERENCE TO RELATED APPLICATIONS

This application claims benefit of Italian patent application number 102017000082714, filed Jul. 20, 2017, which is herein incorporated by reference.

BACKGROUND OF THE INVENTION

Field of the Invention

The present invention relates to a folding chair.

More specifically, the invention relates to a folding chair comprising a pair of front legs and a pair of rear legs movable between an open position and a closed position, and a seat movable between a lowered seating position and a raised storage position.

Description of Prior Art

U.S. Pat. No. 3,705,744 describes a folding chair comprising a first structure including a pair of front legs and a backrest, a second structure including a pair of rear legs, and a seat articulated to the first and second structure about a transverse articulation axis. The first and second structures are movable about the transverse articulation axis between an open position and a closed position and the seat is movable about the transverse articulation axis between a lowered position and a raised position.

Folding chairs of this type are mostly equipped with backrests of reduced dimensions. This is due to the fact that, in the storage configuration, the seat and the backrest occupy the same plane or parallel planes very close to each other. If the backrest has a large size, in the storage position the seat and the backrest overlap with each other and, consequently, there is a substantial thickness of the chair in the storage configuration.

To limit the thickness of the chair in the storage configuration, chairs with a small backrest are generally used. In most cases, backrests of folding chairs offer the user a very limited support, and are located exclusively in the area of the shoulder blades. This solution thus has the disadvantage of reduced comfort.

SUMMARY OF THE INVENTION

The object of the present invention is to overcome the drawbacks of the prior art.

More particularly, the invention aims to provide a folding chair having a backrest with a support surface that also extends into the lumbar region of the user and that, at the same time, has a reduced thickness in the storage configuration.

According to the present invention, this object is achieved by a folding chair having the features disclosed herein.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

It will be appreciated that, for clarity and simplicity of illustration, the various figures may not be reproduced on the same scale.

DETAILED DESCRIPTION

Figure 1:
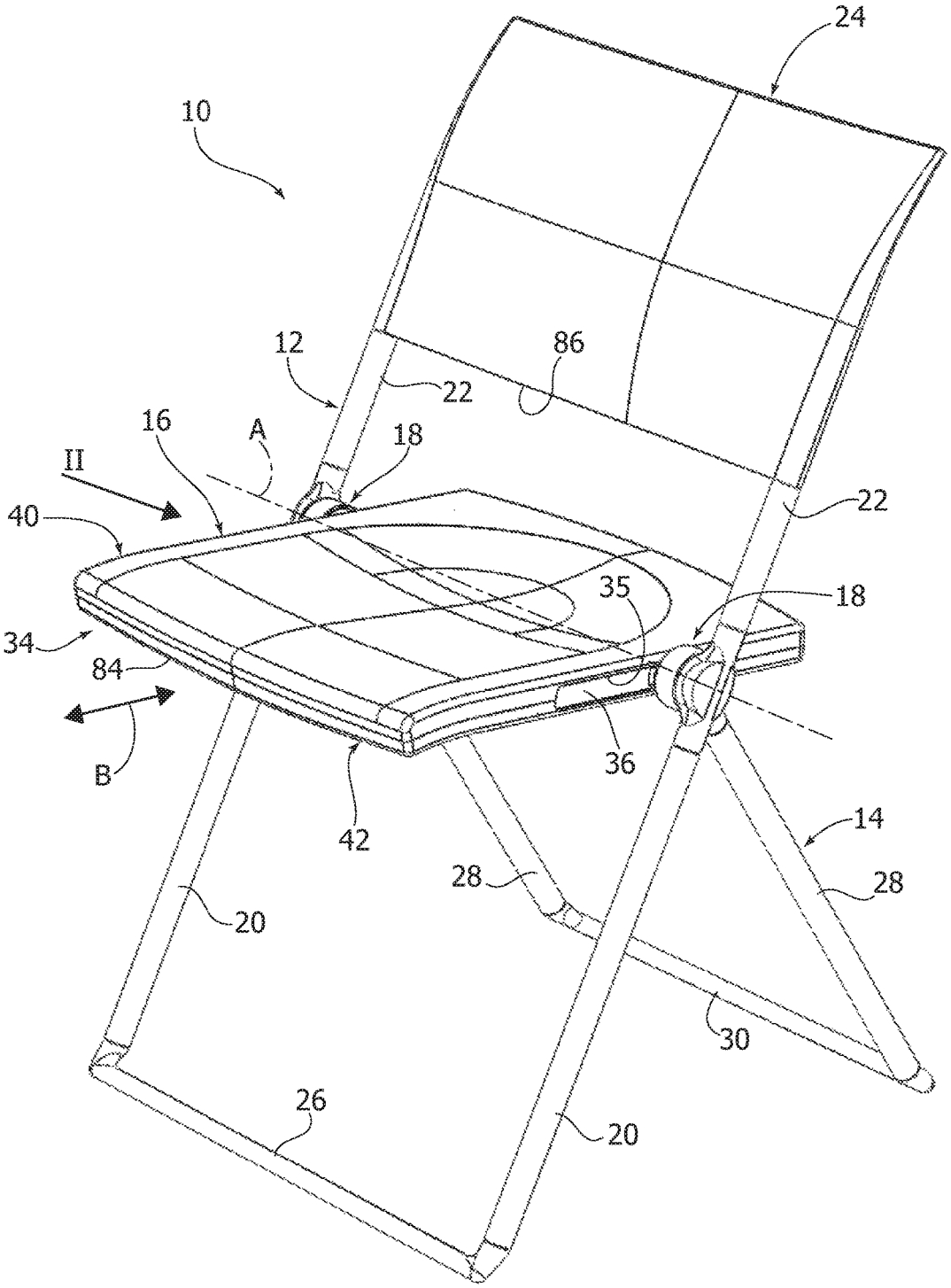
FIG. 1 is a perspective view of an embodiment of a folding chair according to the invention in an open position.

With reference to FIG. 1, numeral 10 indicates a folding chair according to an embodiment of the present invention. The chair 10 comprises a first structure 12, a second structure 14, and a seat 16, articulated together about a common articulation axis A by means of a pair of joints 18.

The first structure 12 comprises a pair of front legs 20 and a pair of backrest supports 22 that form upward extensions of the respective front legs 20. The first structure 22 comprises a backrest 24 fixed to the backrest supports 22. The lower ends of the front legs 20 can be joined together by a front cross member 26.

The second structure 24 comprises a pair of rear legs 28 having lower ends that can be joined together by a rear cross member 30.

Figure 2:
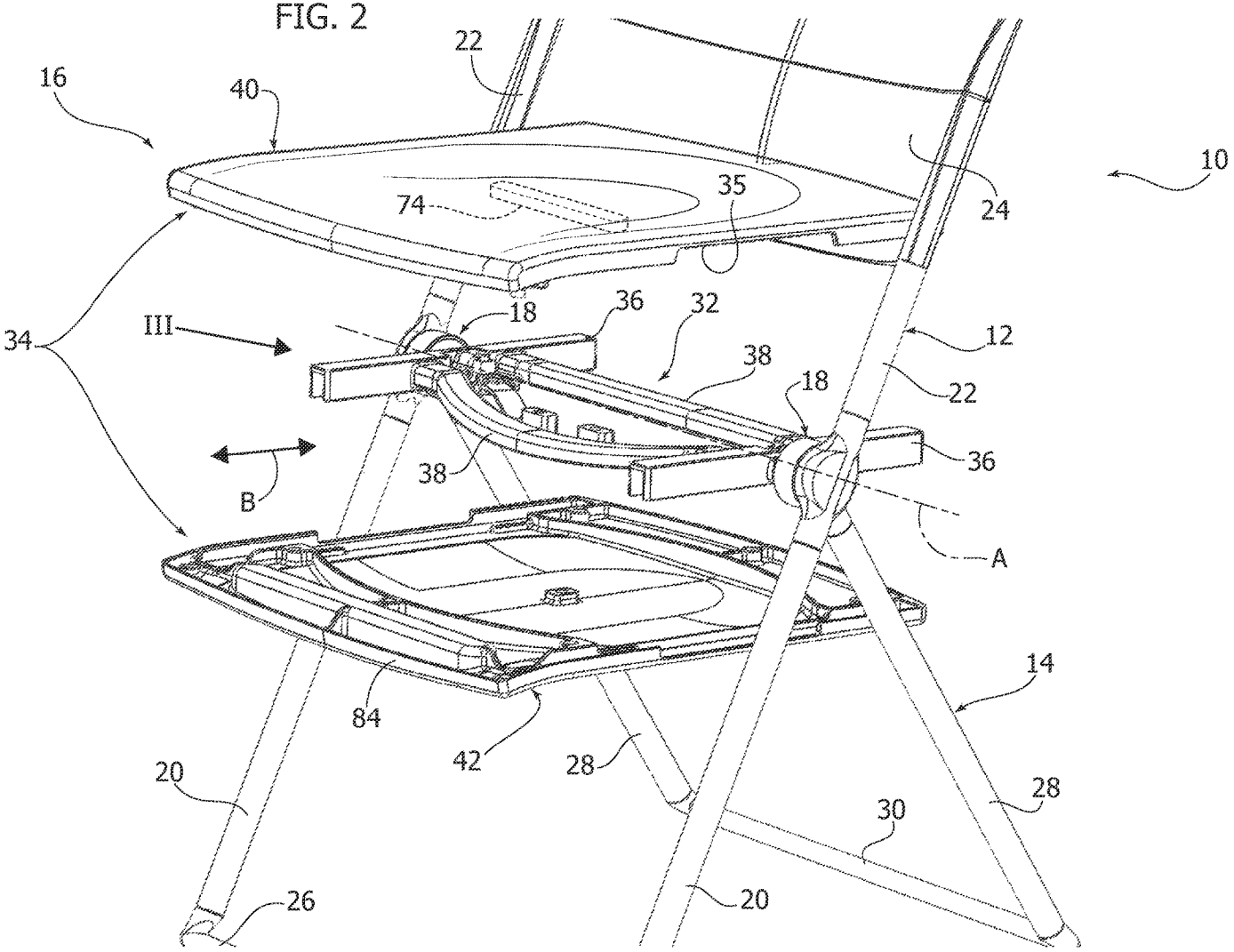
FIG. 2 is an exploded perspective view of the part indicated by the arrow II in FIG. 1.

With reference to FIG. 2, the seat 10 comprises a support frame 32 and a seating element 34. The support frame 32 pivots about the articulation axis A between a lowered position and a raised position and vice versa. The seating element 34 is movable with respect to the support frame 32 along a direction B transverse to the articulation axis A between a first position corresponding to the lowered position of the support frame 32 and a second position corresponding to the raised position of the support frame 32. The seating element 34 can be provided with slots 35 located on the sides at the joints 18, so that the joints 18 do not hinder the movement of the seating element 34 with respect to the support frame 32.

Figure 3:
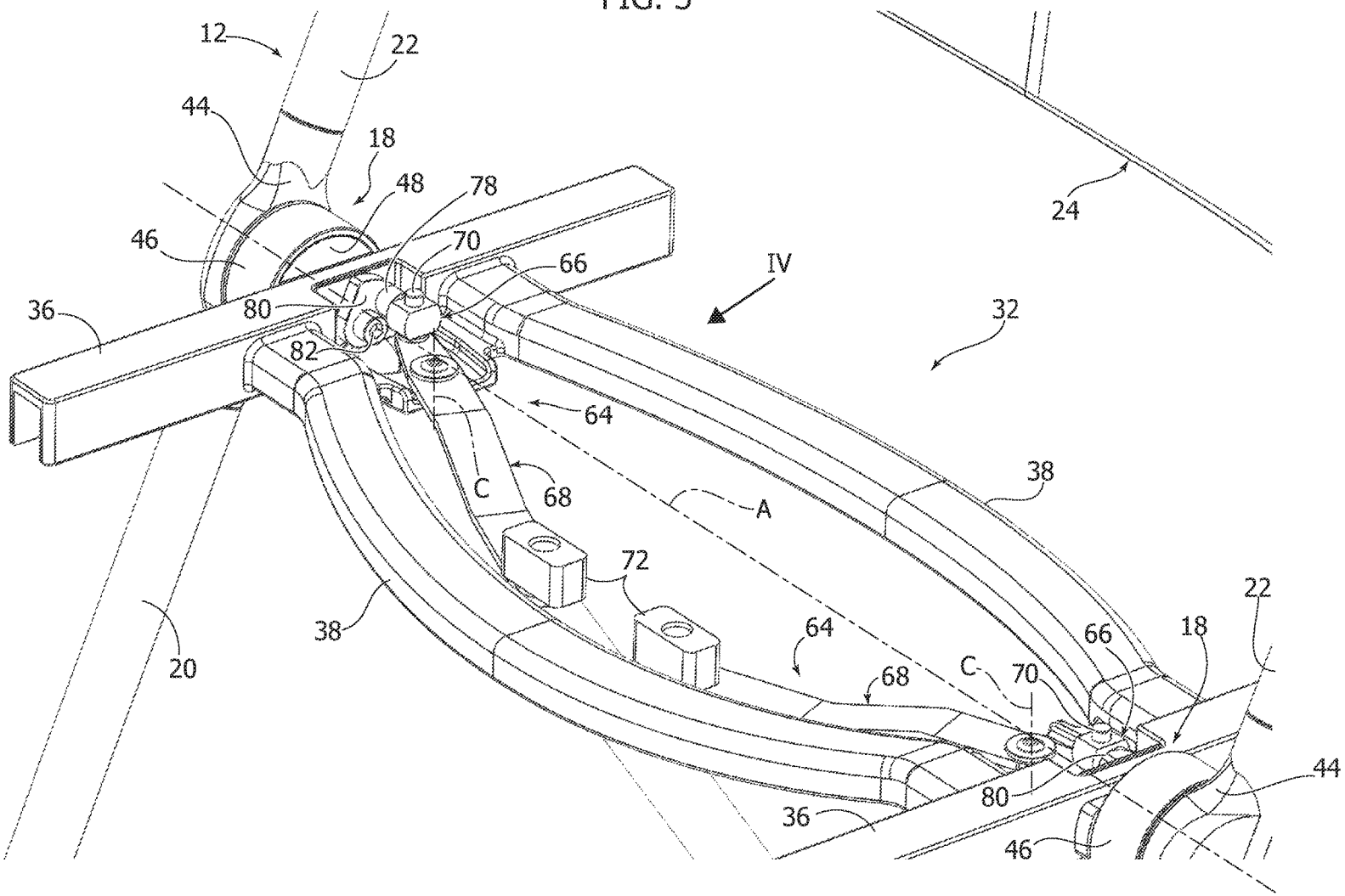
FIG. 3 is a perspective view on an enlarged scale of the part indicated by the arrow III in FIG. 2.
Figure 4:
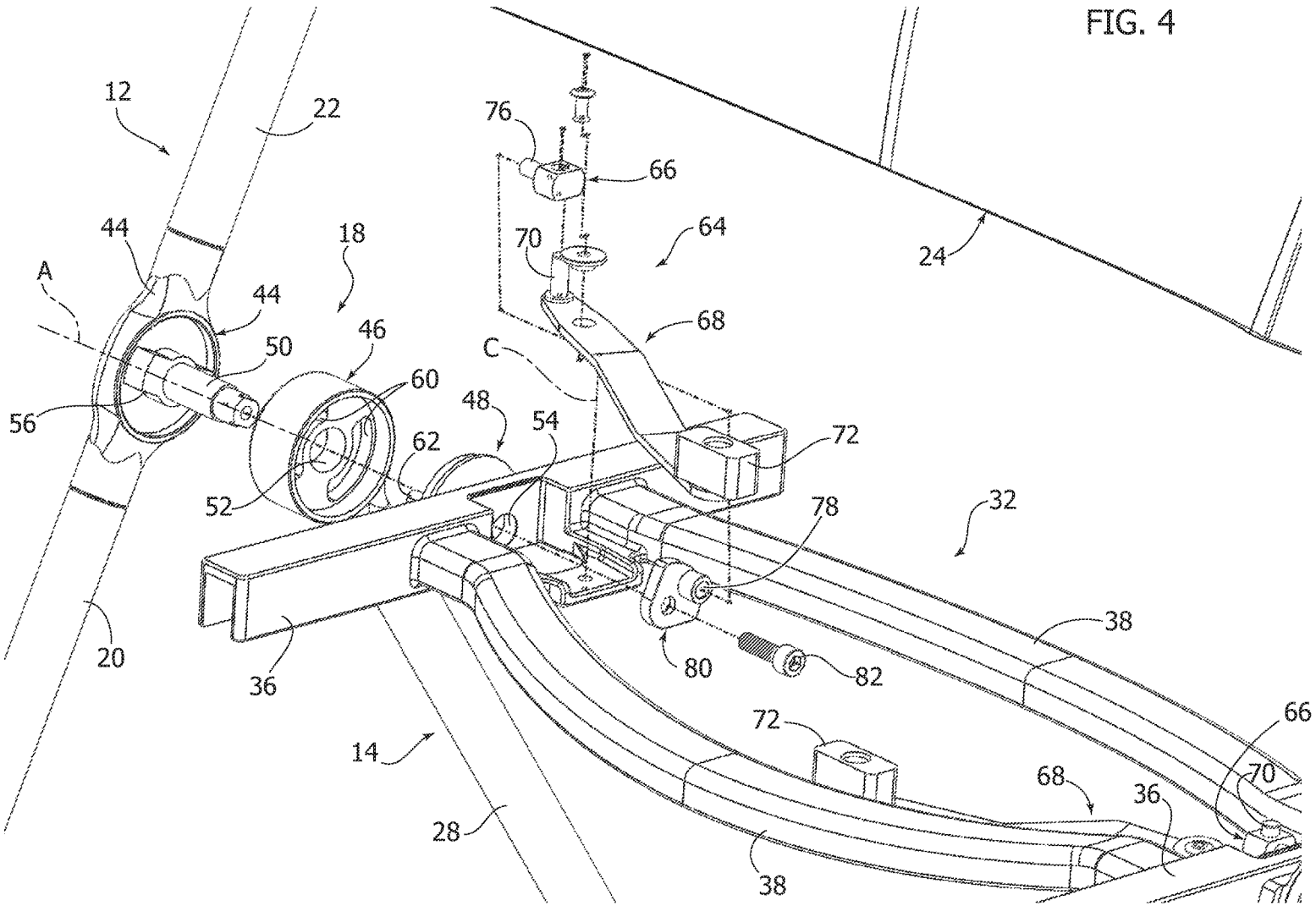
FIGS. 4 and 5 are exploded perspective views from different angles of the part indicated by the arrow IV in FIG. 3.

With reference to FIGS. 2, 3 and 4, in one embodiment, the support frame 32 may comprise two parallel guides 36 joined together by two cross members 38. With reference to FIG. 2, in one embodiment the seating element 34 may comprise two panels of plastic material 40, 42 fixed together on opposite sides of the support frame 32. The two panels 40, 42 can slidably engage the guides 36 of the support frame 32 to guide the movement of the seating element 34 in the direction B. The two panels 40, 42 can be fixed to each other by screws or by snap-engagement formations. The support frame 32 can be entirely enclosed between the two panels 40, 42 forming the seating element 34.

Figure 5:
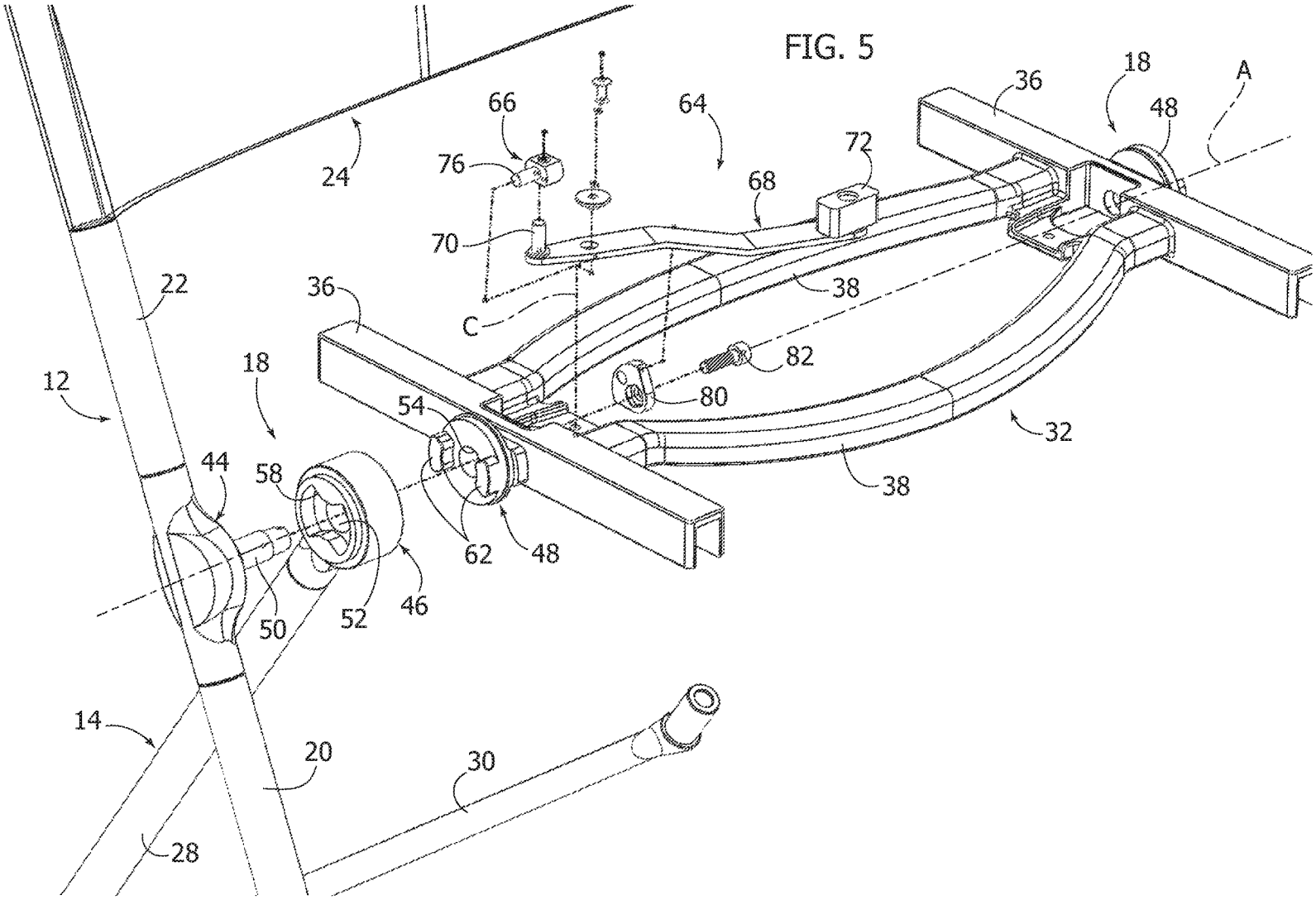

With reference to FIGS. 4 and 5, each joint 18 comprises a first joint element 44 fixed to the first structure 12, a second joint element 46 fixed to the second structure 14 and a third joint element 48 fixed to the support frame 32. The first joint element 44 can be fixed between the upper end of a respective front leg 20 and the lower end of a respective backrest support 22. The second joint element 46 can be fixed to the upper end of a respective rear leg 28. The third joint element 48 can be fixed on the outer side of a respective guide 36 of the support frame 32.

Each joint 18 comprises an articulation pin 50 coaxial with the axis A, fixed to the first joint element 44 and about which the second joint element 46 and the third joint element 48 are rotatable. The articulation pin 50 extends through holes 52 and 54 of the second joint element 46 and the third joint element 48.

With reference to FIGS. 4 and 5, the first joint element 44 comprises a first stop formation 56 that cooperates with a second stop formation 58 of the second joint element 46 to define two stop positions between the first and the second structure 12, 14, corresponding to the open chair position and to the closed chair position. The second joint element 46 comprises a third stop formation 60 that cooperates with a fourth stop formation 62 of the third joint element 48, which define two stop positions of the support frame 32 of the seat 16 with respect to the second structure 14. The stop formations 56, 58, 60, 62 can be formed by teeth or openings/grooves.

With reference to FIGS. 2-5, the seat 16 comprises at least one transmission mechanism 64 cooperating with at least one of the joints 18 and with the seating element 34. The transmission mechanism 64 is configured to move the seating element 34 relative to the support frame 32 along the direction B between a first position corresponding to a lowered position of the seat 16 and a second position corresponding to a raised position of the seat 16. In one embodiment, the seat 16 comprises two transmission mechanisms 64 cooperating with respective joints 18.

With reference to FIGS. 3, 4 and 5, each transmission mechanism 64 comprises a first transmission member 66 connected to the first joint element 44 and a second transmission member 68 connected to the seating element 34.

In one embodiment, the second transmission member 68 is articulated to the support frame 32 about an axis C transverse to the articulation axis A. A first end of the second transmission member 68 carries a first pin 70 parallel to the axis C on which the first transmission member 66 is rotatable. A second end of the second transmission member 68 carries a shoe 72 which slidably engages a transverse seat 74 (FIG. 6) of the seating element 34.

The first transmission member 66 comprises a second pin 76 which rotatably engages a hole 78 of a plate 80 fixed, for example, by means of a screw 82, at a distal end of the articulation pin 50 of the first joint element 44. The second pin 76 is perpendicular with respect to the first pin 70. The hole 78 of the plate 80 is parallel and eccentric with respect to the articulation axis A.

The plate 80 is fixed with respect to the first structure 12. A pivoting movement of the support frame 32 about the articulation axis A involves an articulation movement of the first transmission member 66 about the axis A. This articulation movement of the first transmission member 66 imparts a pivoting movement to the second transmission member 68 about the axis C. The second transmission member 68, by means of the shoe 72, moves the seating element 34 along the direction B, perpendicular to the articulation axis A.

Figure 6:
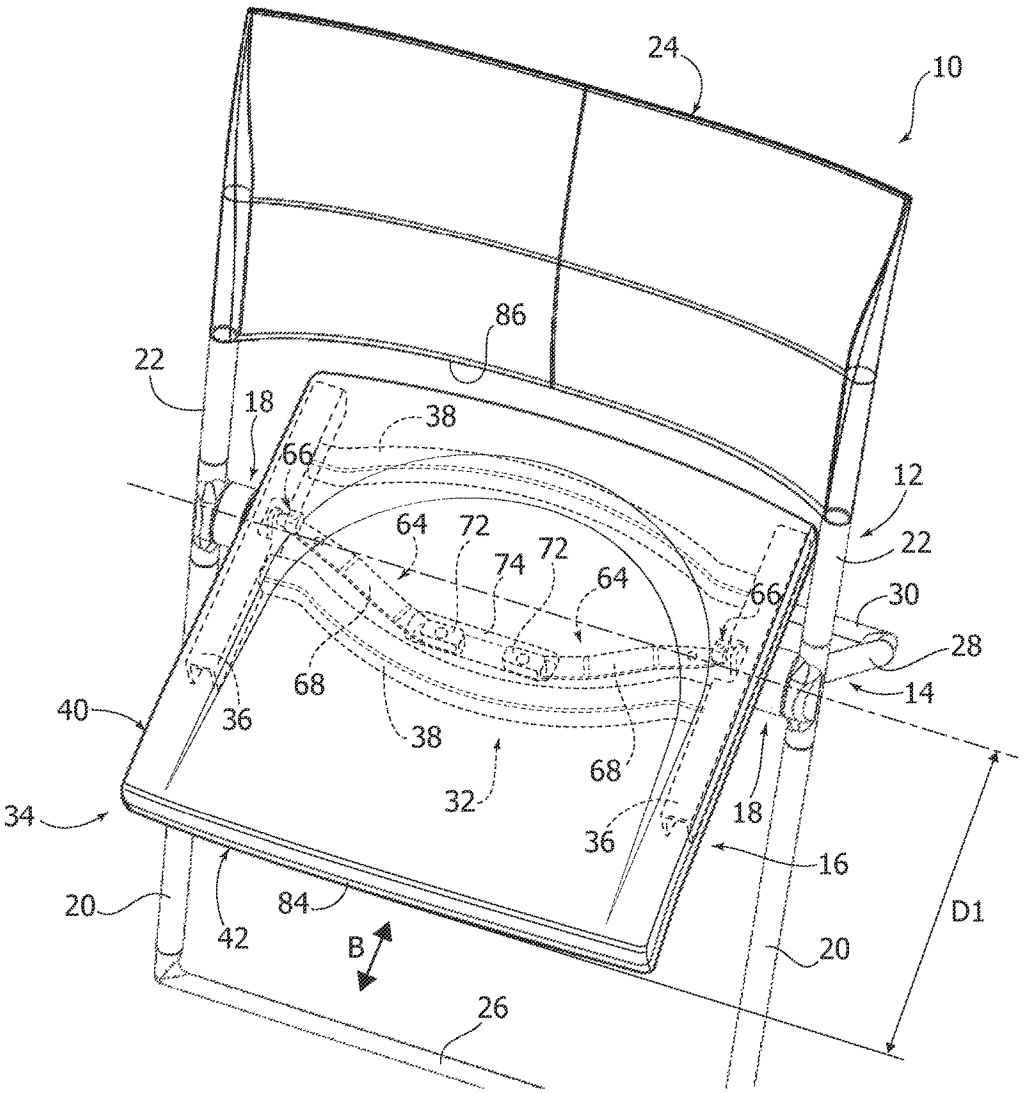
FIGS. 6 and 7 are perspective views illustrating the chair according to the invention in an open position and in a closed position.

FIG. 6 illustrates the chair 10 in the configuration of use. The first and second structures 12, 14 are in an open configuration and the seat 16 is in a lowered position. In this condition, a front edge 84 of the seating element 34 is at a first distance D1 with respect to the articulation axis A.

Starting from the configuration of use, to close the chair 10, the seat 16 is raised, making it rotate upwards about the articulation axis A. The rotation of the seat 16 about the axis A moves the second structure 14 from the open position towards the closed position due to contact between the stop formations 60, 62 of the second and third joint elements 46, 48.

Figure 7:
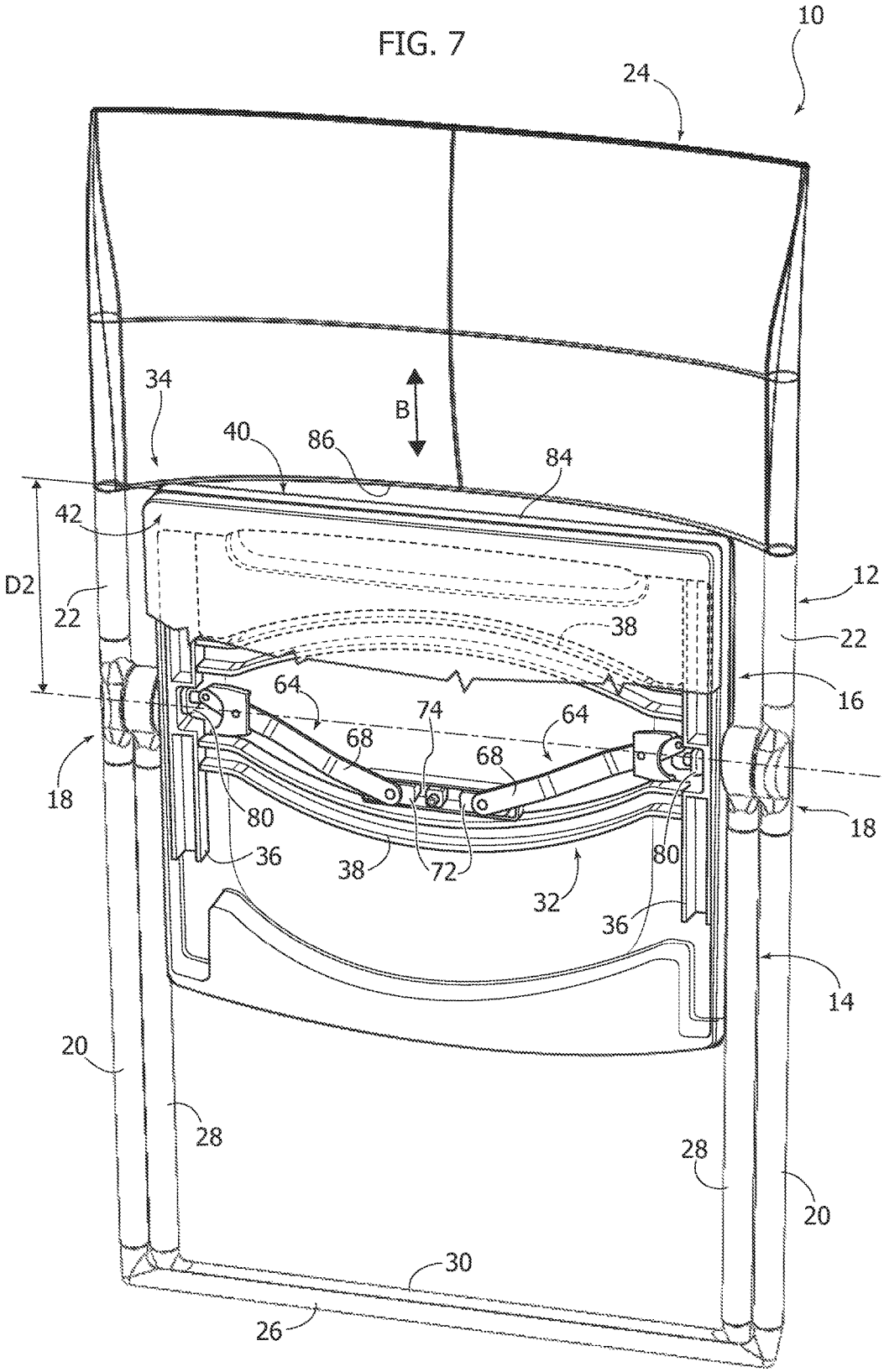

FIG. 7 illustrates the chair 10 in the storage configuration. In this configuration, the first and second structures 12, 14 are closed and the front and rear legs 20, 28 are parallel to each other. The seat 16 is in a raised position.

During the movement from the lowered position to the raised position of the seat 16, the seating element 34 moves with respect to the support frame 32 of the seat 16 in the direction B. In the storage configuration illustrated in FIG. 7, the front edge 84 of the seating element 34 is at a second distance D2 with respect to the articulation axis A. The second distance D2 is less than the first distance D1. The movement in the direction B of the seating element 34 makes it possible to provide a backrest 24 of large dimensions, in particular providing a support for the lumbar region of the user, without there being an overlap between the backrest 24 and the seating element 34 in the storage configuration. Therefore, the dimensions of the chair 10 in the storage configuration are limited despite the backrest 24 having a large size.

In particular, in the storage configuration, the front edge 84 of the seating element 34 is located below the lower edge 86 of the backrest 24 and there is no overlap between the seating element 34 and the backrest 24.

Of course, the embodiments and details of construction may vary with respect to that described and illustrated. For example, the transmission mechanism 64 that controls the movement of the seating element 34 relative to the support frame 32 can be made differently from that illustrated in the drawings. For example, any mechanism capable of transforming an articulation movement into a translation movement can be used. For example, transmission mechanisms using toothed members could be used.

The invention claimed is:

1. A folding chair comprising:

a first structure including a pair of front legs and a backrest;

a second structure including a pair of rear legs articulated with respect to the first structure about an articulation axis and movable with respect to the first structure between an open position and a closed position; and a seat movable about said articulation axis between a lowered position and a raised position, wherein said seat comprises:

a support frame pivoting about said articulation axis between a lowered position and a raised position;

a seating element movable with respect to the support frame along a direction transverse with respect to said articulation axis; and at least one transmission mechanism configured to move the seating element along said direction between a first position corresponding to the lowered position of the support frame and a second position corresponding to the raised position of the support frame, wherein in said first position, a front edge of the seating element is at a first distance from said articulation axis and in said second position, the front edge of the seating element is at a second distance from the articulation axis, and wherein said second distance is less than said first distance.

2. A folding chair according to claim 1, comprising a pair of joints defining said articulation axis, wherein each joint comprises:

a first joint element fixed to the first structure;

a second joint element fixed to the second structure and pivoting with respect to said first joint element about said articulation axis; and a third joint element fixed to said support frame and pivoting with respect to said first joint element about said articulation axis.

3. A folding chair according to claim 2, wherein said transmission mechanism comprises a first transmission member connected to said first joint element and a second transmission member articulated to the support frame about a second axis transverse to said articulation axis and cooperating with said seating element.

4. A folding chair according to claim 3, wherein said first transmission member is articulated to said second transmission member about a first pin parallel to said second axis.

5. A folding chair according to claim 4, wherein said first transmission member has a second pin that rotatably engages a hole of a plate fixed to said first joint element.

6. A folding chair according to claim 2, comprising two transmission mechanisms cooperating with respective joints.

7. A folding chair according to claim 1, wherein said seating element comprises two panels located opposite to said support frame.

8. A folding chair according to claim 1, wherein said seating element does not overlap with the backrest in a storage configuration.

* * * * *